United States Patent [19]

Walters

[11] 3,990,608

[45] Nov. 9, 1976

[54] CONTAINER TAPPING DEVICES

[76] Inventor: Tom Walters, 2102 Mason Blvd., Point Pleasant, W. Va. 25550

[22] Filed: Mar. 10, 1975

[21] Appl. No.: 556,937

[52] U.S. Cl. ..... 222/91; 30/6.4

[51] Int. Cl.[2] ..... B67B 7/26

[58] Field of Search ..... 222/80, 81, 82, 83.5, 222/85, 86, 88–91, 568; 30/541, 6.4

[56] References Cited

UNITED STATES PATENTS

| | | | |
|---|---|---|---|
| 1,048,202 | 12/1912 | Oberg | 30/6.4 |
| 1,868,930 | 7/1932 | Thompson | 222/91 |
| 2,001,481 | 5/1935 | Abbott | 222/90 |
| 2,594,161 | 4/1952 | Harrison | 222/83.5 |

FOREIGN PATENTS OR APPLICATIONS

| | | | |
|---|---|---|---|
| 67,219 | 7/1892 | Germany | 222/83 |

*Primary Examiner*—Robert B. Reeves
*Assistant Examiner*—H. Grant Skaggs

[57] ABSTRACT

Tubular conduits with axially overlapping parts are swivelly keyed to each other by an annular key and a retaining nut. A cutter tip is on the end opposite the swivel end of the outer conduit along with an internal support housing a square yoke that slidably receives the square shank of a centrally positioned shaft which is threaded one end and square the other. The threaded end of the shaft is housed by a threaded internal boss affixed within the inner conduit. The square end of the shaft is tipped with a cork screw type attachment, for engaging the subsequent cut away container blank, that rotates and functions as such when the outer conduit is rotated. Rotation of the inner conduit slidably positions the shaft assembly, advancing or retracting, with respect to the cutter tip area of the outer conduit in a non-rotating manner.

9 Claims, 11 Drawing Figures

CONTAINER TAPPING DEVICES

This invention relates in general to devices for cutting openings in sealed connections of plastic, fiberglas or the like containers and more particular to tapping said containers when full of liquid and controlling the cut out portion within the container for its subsequent removal.

With the advent of 55 gallon drums and the like made of plastic with new innovations such as blanked connections being molded therein for subsequent dispensing of the container's contents, various cutting and or tapping devices become a necessity.

It is, therefore, an important object of the present invention to provide suitable devices to conveniently and safely cut and or tap such containers full of liquid without fumes and or spillages.

In accordance with the present invention, an inner conduit member is provided with male pipe threads for valve or piping attachment, a hexagonal nut as part thereof for wrench holding/rotating, a handle for hand rotation, an annular groove to receive the positioning key, an annular recess to receive and O-ring sealing element to provide the seal between the inner and outer conduits, and a centrally positioned threaded internal boss supported within and affixed to said conduit to receive the threaded portion of an inner shaft.

An outer conduit is provided with male threads to receive a retaining nut, a hexagonal nut section as part thereof for wrench rotation, male acme or the like threads for engaging the container's threaded boss, annular recesses to receive O-ring sealing elements to effect seals during and after the cutting/tapping operation, a cutter tip and guide shroud for cutting/tapping the container's connection, and a centrally positioned square holed internal boss supported within and affixed to the outer conduit that slidably receives the square shank portion of the inner shaft which has a corkscrew type attachment at its tip for subsequently engaging and seizing the container's connection blank at the cutting/tapping operation.

As an assembled unit applied to a container's blanked connection, the cutter tip end is entered into the connection recess to engage the acme or the like threads of the outer conduit into like threads in the connection boss where further rotation of the outer conduit advances the cutter tip to make the blank cutout while the corkscrew assembly advances to engage and seize said blank and further control the position of the cut blank by rotating the inner conduit member advancing to permit full flow area, withdrawing for the subsequent blank removal from the container.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
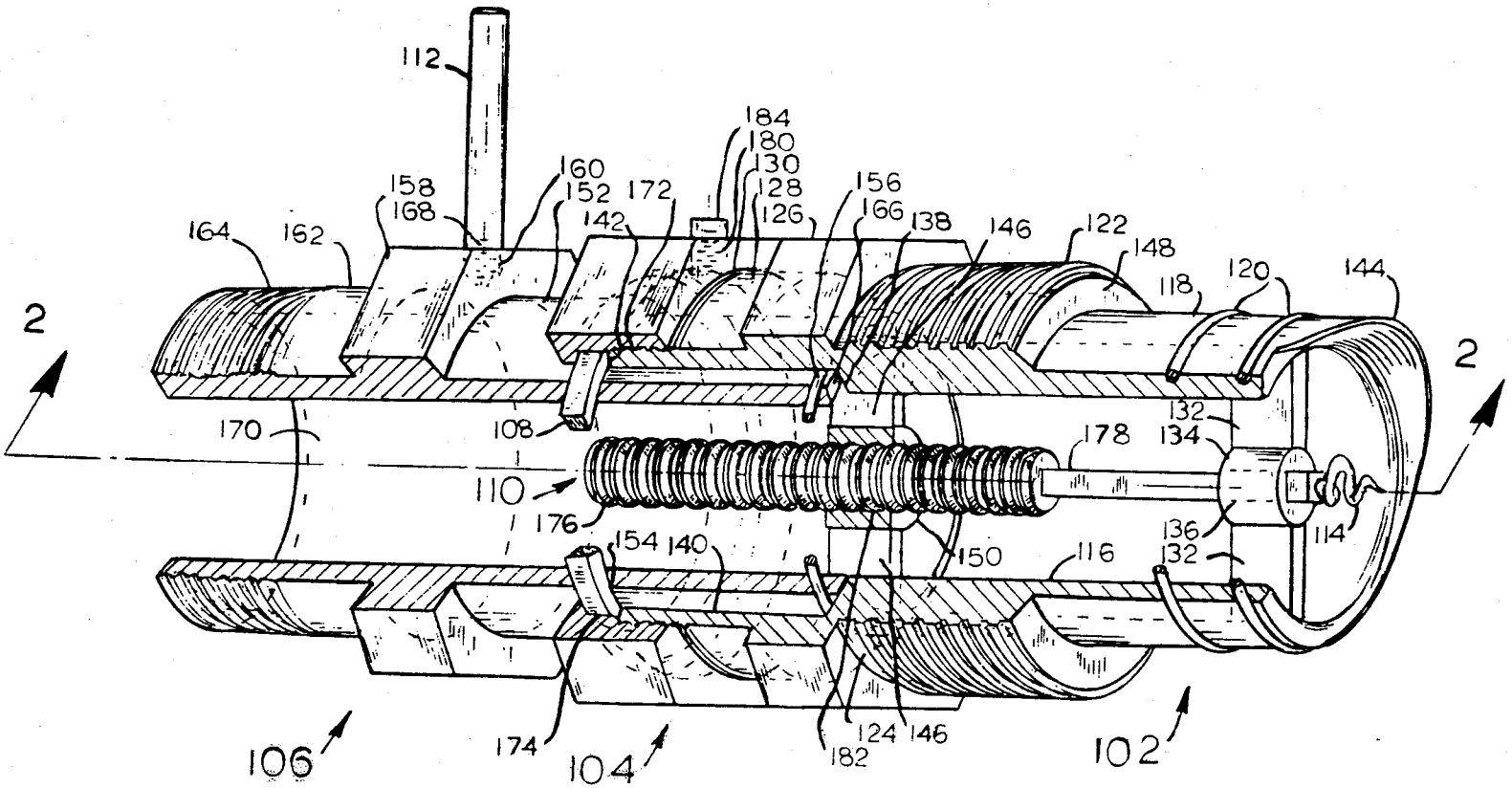
FIG. 1 is a sectional perspective view showing the assembled parts of the present invention.
Figure 3:
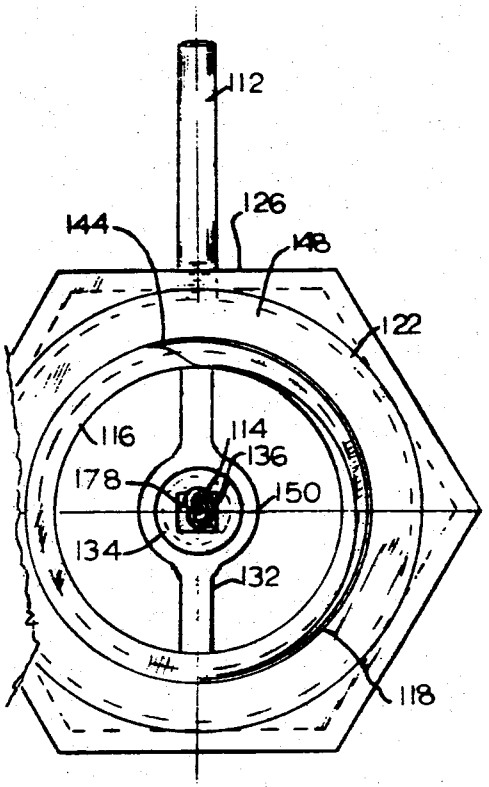
FIG. 3 is an end view showing the assembly at the cutter tip end.
Figure 2:
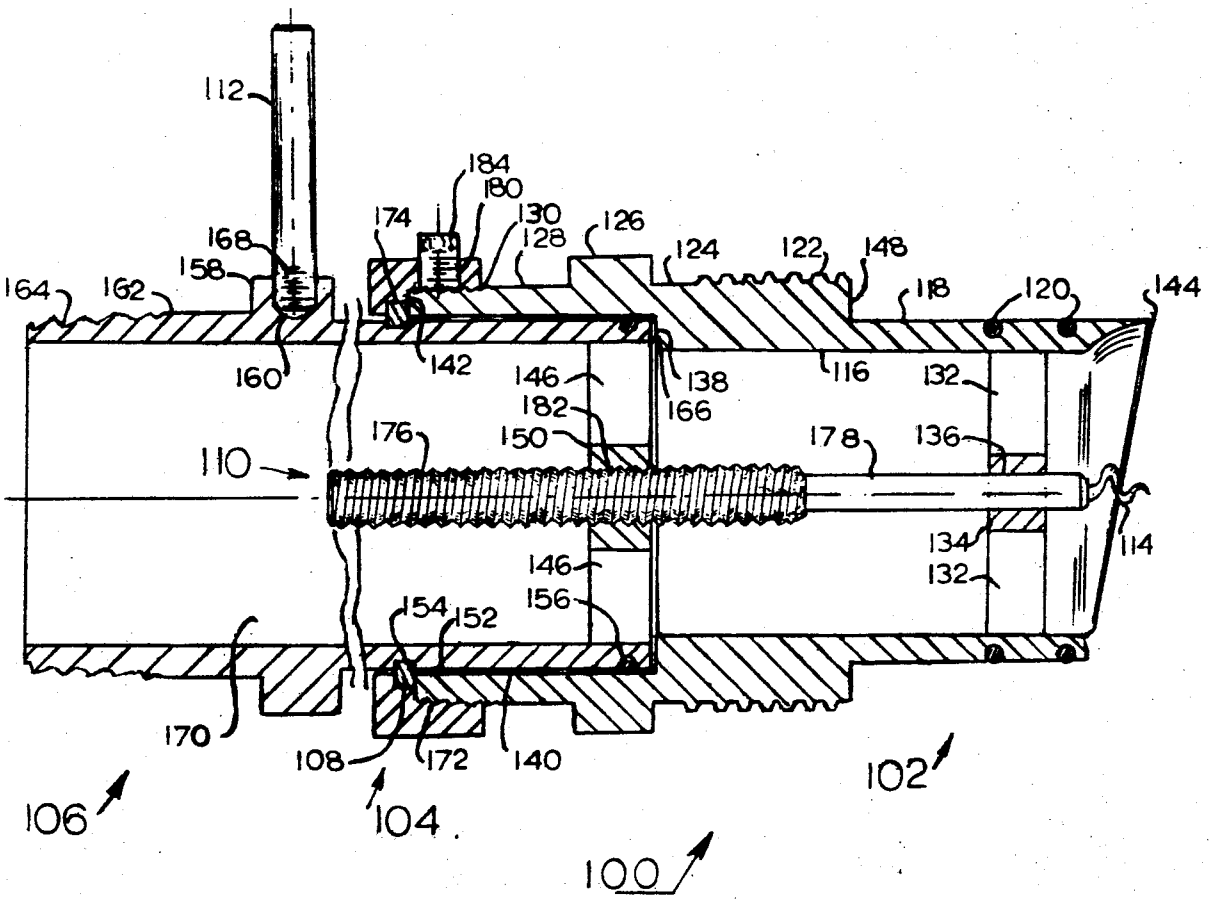
FIG. 2 is a side sectional view taken substantially through a plane indicated by section line 2—2 in FIG. 1 showing the assembled parts.

Referring now to the drawings in detail, FIGS. 1, 2 and 3 show a typical cutting/tapping unit assembly 100 constructed in accordance with the present invention. An essentially outer conduit member 102 and an essentially inner conduit member 106 swivelly keyed together by split ring key 108 and retaining nut 104, rotatably sealed by O-ring seal element 156 between the over lapping ends are both essentially yoked to a common traveller shaft 110. Said shaft's rotary motion is induced by the rotation of member 102 while said shaft's non-rotating lineal motion is induced by the rotation of member 106.

The outer conduit member 102 with cylindrical surface 118 annularly recessed for O-ring seals 120 and cutter tip 144 affixed has acme or the like threads 122 on cylindrical shoulder 124, has hexagonal nut 126 affixed for subsequent said member rotation, has cylindrical surface 128 with threads 130 to receive threads 172 of retaining nut 104, has internal cylindrical sealing surface 140 that engages O-ring seal element 156, has abutment shoulder 138 leading internally to cylindrical surface 116 which has support bars 132 affixed centrally positioning hub 134 that houses square opening 136 that slidably receives shank 178 of traveller shaft 110.

The inner conduit member 106 has cylindrical surface 152 with annular recess 154 that receives split ring key 108, has annular recess for O-ring seal element 156, has abutment end 166 to firm against abutment 138 of member 102, has hexagonal nut 158 affixed for subsequent holding and/or rotating, has handle 112 with threads 168 engaged within tapped hole 160 of nut 158 for hand rotation of said member to induce movement of traveller shaft 110, has cylindrical surface 162 with threads 164 to receive attachments, and has internal cylindrical surface 170 which has support bars 146 affixed centrally positioning hub 150 that houses left hand threads 182 that receive threads 176 of traveller shaft 110.

Retaining nut 104 has threads 172 received by threads 130 of member 102, has internal annular recess 174 that slidably receives split ring key 108, and has tapped hole 180 that receives set screw 184 which is used to engage into threads 130 of the outer conduit 102 when recess 174 and end 142 of conduit 102 are firmly and swivelly adjusted about split ring key 108 effecting a locking means of conduits 102 and 106 one to the other and permitting each to rotate independent of the other.

Traveller shaft 110 has left hand threads 176 received by threads 182 of hub 150 of conduit 106, has square shank 178 slidably received by square opening 136 of hub 134 of conduit 102, and has corkscrew type tip 114 affixed at the end of shank 178 for engaging, seizing and controlling the subsequently cutout container connection blank as explained later.

Figure 4:
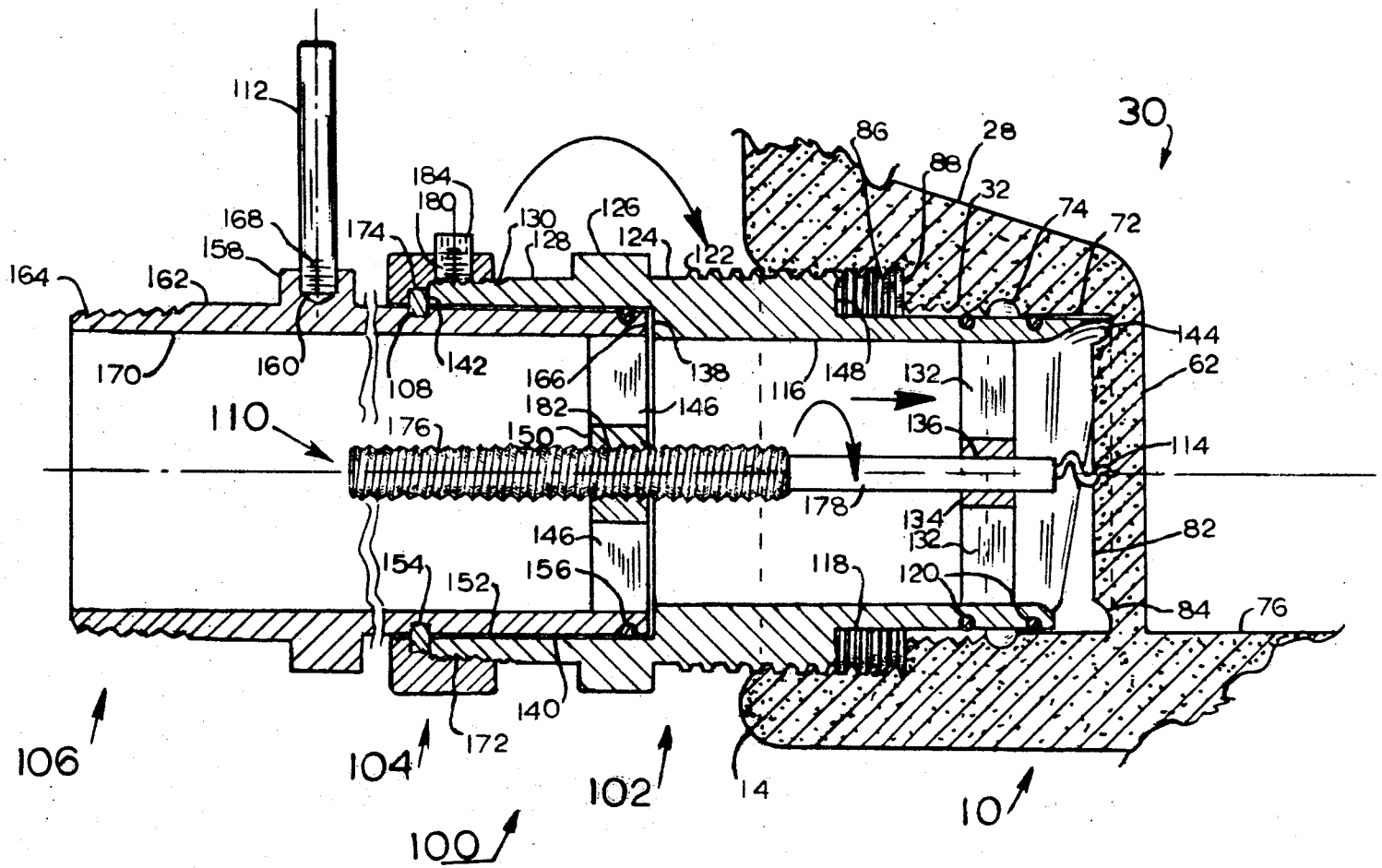
FIG. 4 is a side elevational view showing the cutter/-tapping unit entered into and partially engaged within a container's typical blanked connection for the initial step of the cutting/tapping procedure.

As illustrative, FIG. 4 shows cutting/tapping unit 100 partially engaged within connection 30 of a fiberglas, plastic, or the like, container 10 with the clockwise rotation of conduit member 102 advancing the cutter tip 144, corkscrew type tip 114 into the cylindrical sealing recess 72 of connection 30 as threads 122 of member 102 are received within threads 86 of connection 30. Cutter tip 144 enters recess 84 of 30, the tip of corkscrew 114 begins engagement of surface 82 of blank 62 of 30 while the foremost O-ring seal element 120 engages sealing surface 72 of connection 30. It being noted that the rotation of member 102, while it carrys the unit the traveller shaft on threads 176 through threads 182 of conduit 106 thus advancing corkscrew 114 faster than cutter tip 144 providing corkscrew 114 with an additional thrust force to firmly press against and piercingly engage blank 62 of connection 30.

Figure 5:
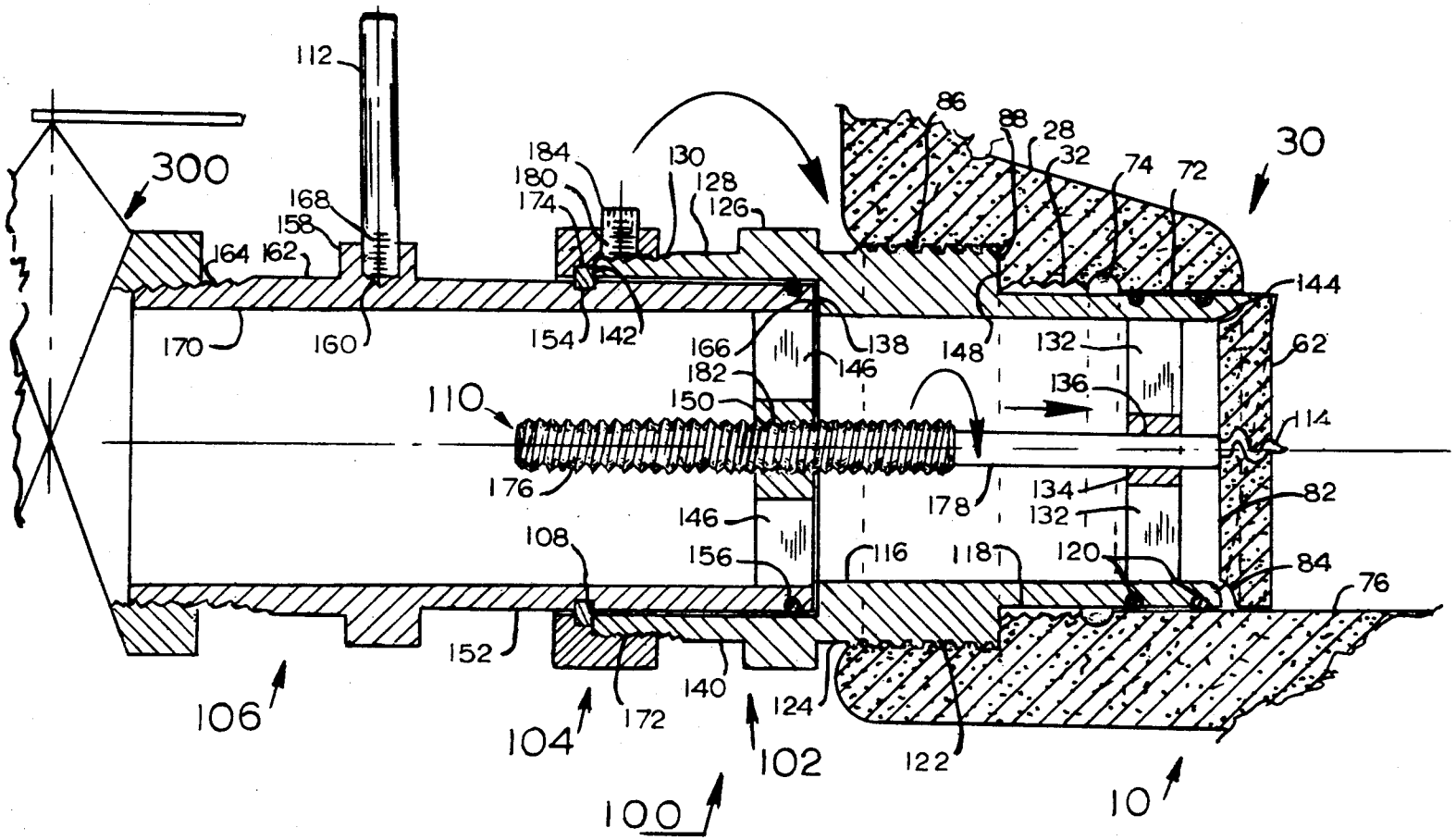
FIG. 5 is a side sectional view showing the cutter/tapping unit with the outer conduit member firmly engaged and sealed within a container's typical blank connection with the blank shown cut free of the connection seized and controlled by the corkscrew type attachment on a traveller shaft.

As illustrative, FIG. 5 shows cutting/tapping unit 100 further advanced and seated within connection 30 to where shoulder 148 of 102 abuts shoulder 88 of connection 30, the following O-ring seal element 120 engages sealing surface 72 of connection 30, cutter 144 has cut through blank 62 of 30 and corkscrew 114 has seizingly engaged said blank. Valve 300 is shown engaged upon threads 164 of member 106 for controlled dispensing purposes.

Figure 6:
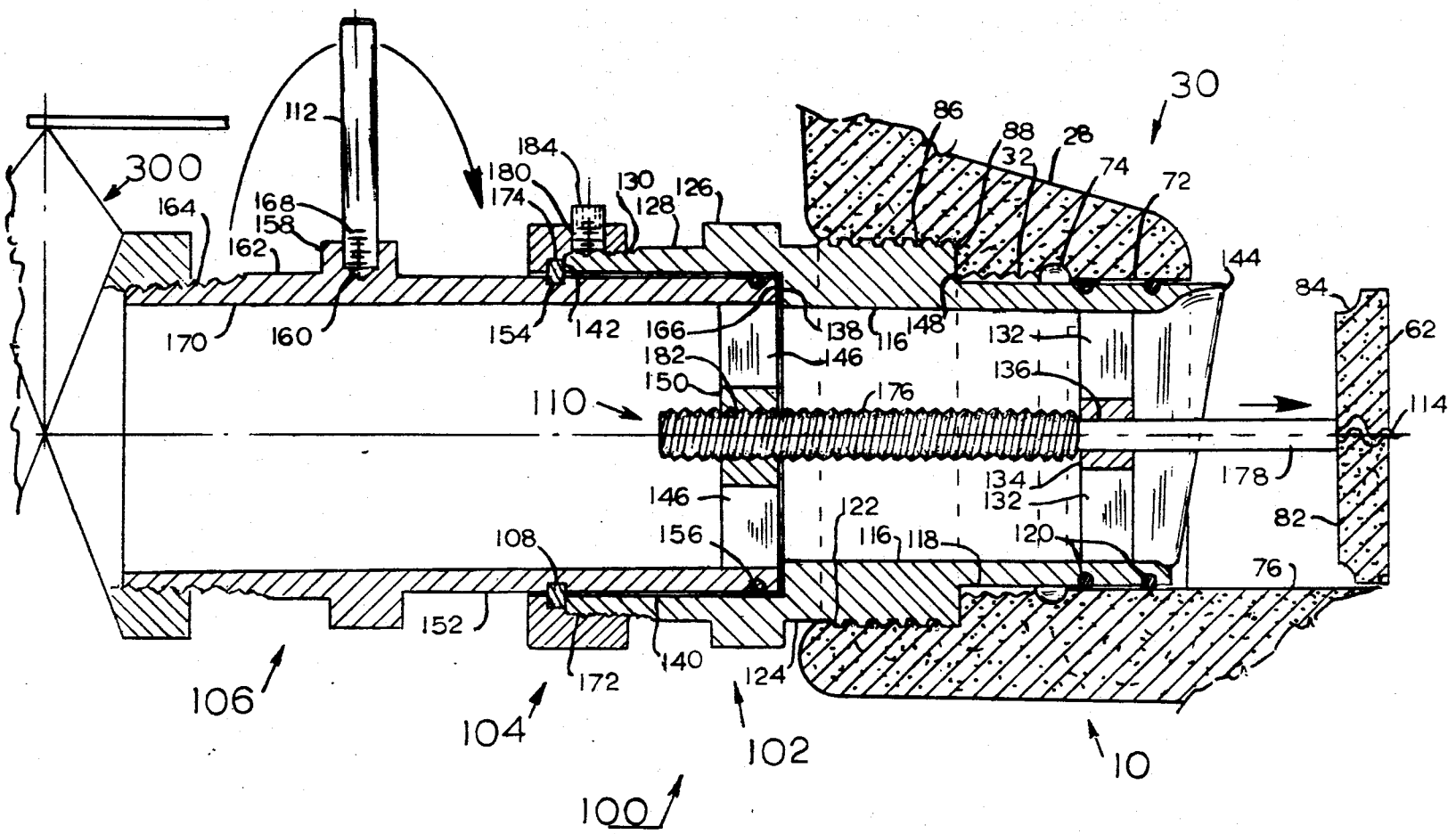
FIG. 6 is a side sectional view showing the cutter/tapping unit firmly engaged and sealed within a container's typical blank type connection with the blank cut free and controlled to advance further to permit full flow of th container's contents through the tapping unit.

As illustrative, FIG. 6 shows unit 100 seated within connection 30 as described with FIG. 5 except that conduit member 106 has been rotated clockwise advancing traveller shaft 110 in a nonrotating lineal motion, with blank 62 of connection 30 controllably seized also advanced into the container to provide full flow area for the container's contents to be dispensed through unit 100.

Figure 7:
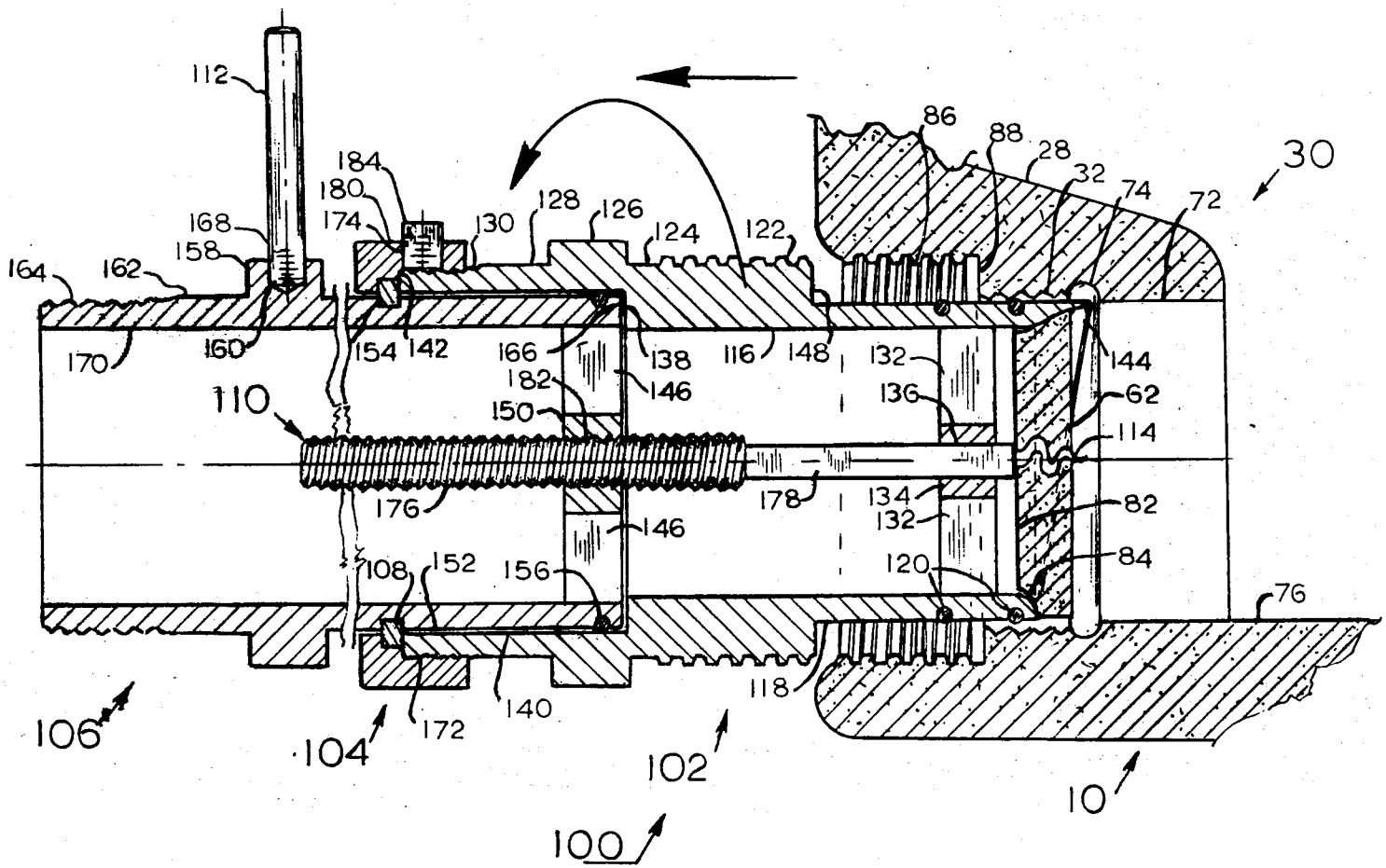
FIG. 7 is a side sectional view showing the removal of the blank with said blank withdrawn into the outer conduit's partial shroud and the outer conduit rotated upon threads provided to disengage the unit from a container's blank type connection.

As illustrative, FIG. 7 shows cutting/tapping unit 100 being withdrawn from connection 30 with conduit member 106 having been rotated counter clockwise until traveller shaft 110 has been withdrawn pulling blank 62 of 30 into the cutting end of member 102. And then member 102 having been rotated counter clockwise to remove the unit 100 as well as blank 62 of connection 30.

Figure 8:
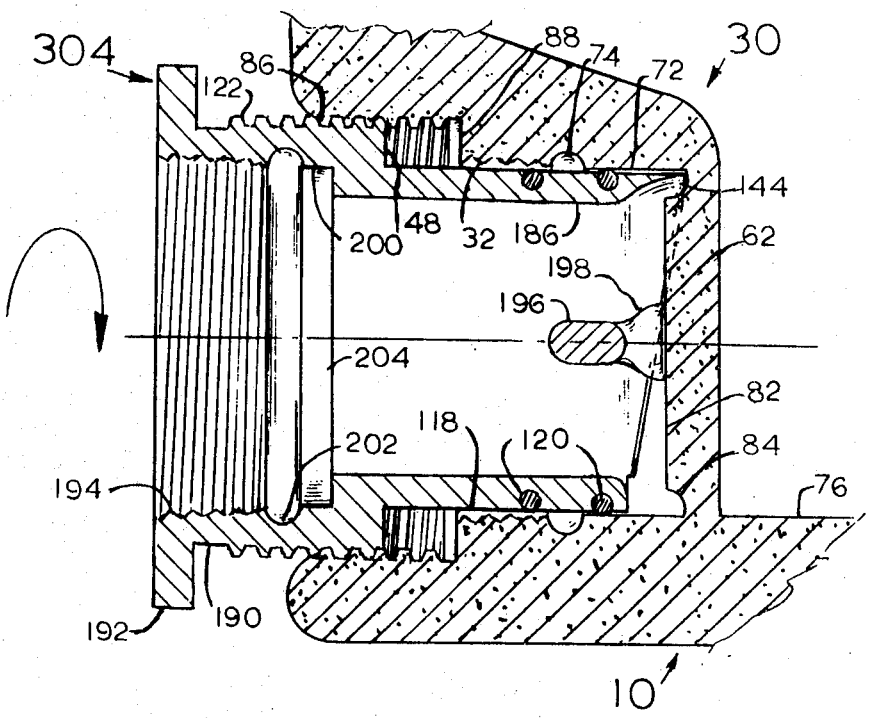
FIGS. 8 and 9 are side sectional views showing a cutting/tapping end of the present invention applied to a container's blank type connection where the blank need not be controlled after cutting. The connections acme or the like threads being used for the engagement.
Figure 9:
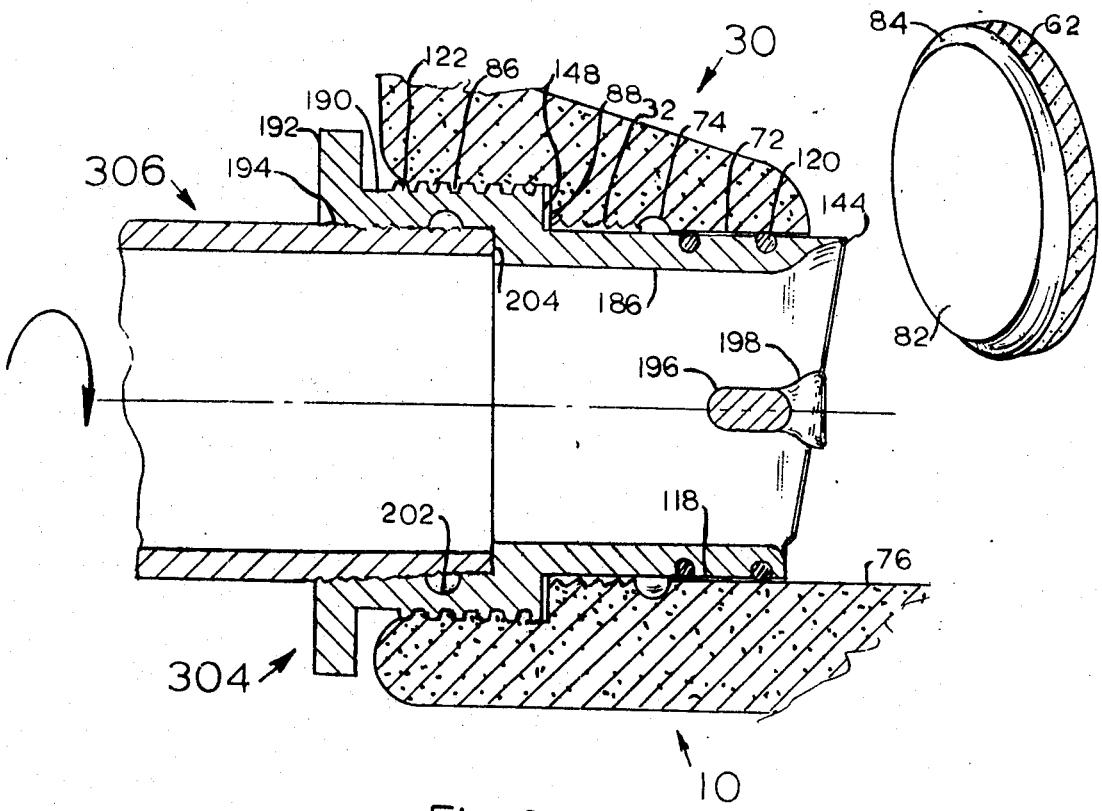

FIGS. 8 and 9 are illustrative views showing a cutting-/tapping end adapter 304 constructed in accordance with the present invention applied to connection 30 of container 10 when conditions do not require seizing and controlling the cutout blank wherein adapter 304, with cutter 144, O-ring seal elements 120, cylindrical surface 118, shoulder 148, and threads 122 being as functional and identical to those of like numbers of member 102 of assembly unit 100.

Adaptor 304 has threads 122 on cylindrical surface 190, hexagonal flange 192 for unit wrench holding-/rotating, threads 194 for attachments such as pipe 306, thread relief recess 202, cylindrical trunk 200 leading to abutment shoulder 204 which leads internally to cylindrical surface 186 with support 196 affixed that centrally positions prod 198, a part thereof, to contact blank 62 of connection 30 to thrust same free at the subsequent cutting/tapping operation.

Figure 10:
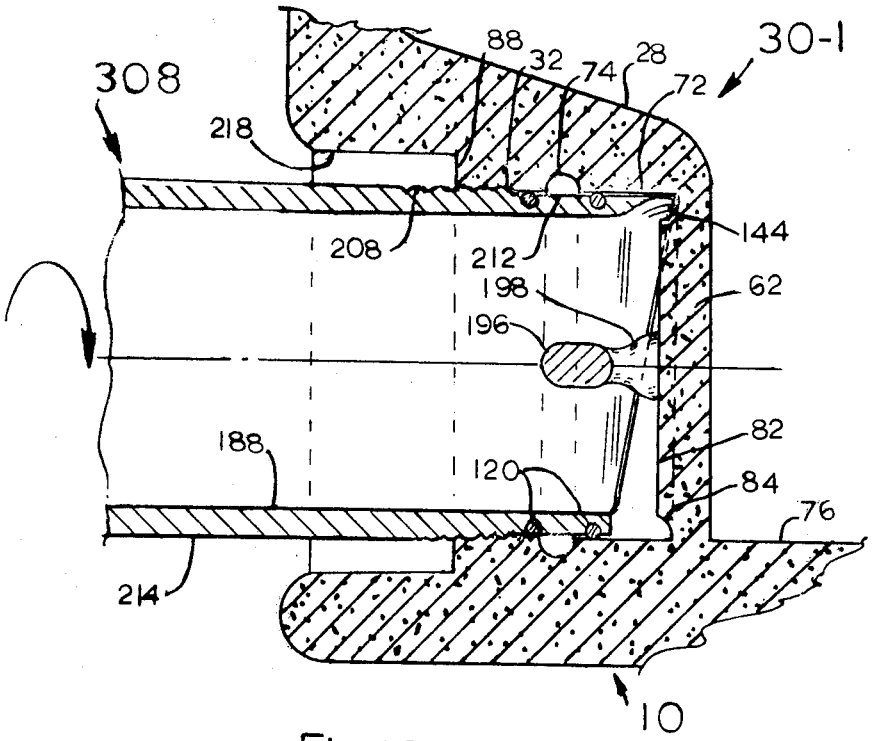
FIGS. 10 and 11 are side sectional views showing a cutting/tapping end of the present invention applied to a container's blank type connection where the blank need not be controlled after cutting and where the acme threads have been omitted, the container's pipe threads are used for the engagement.
Figure 11:
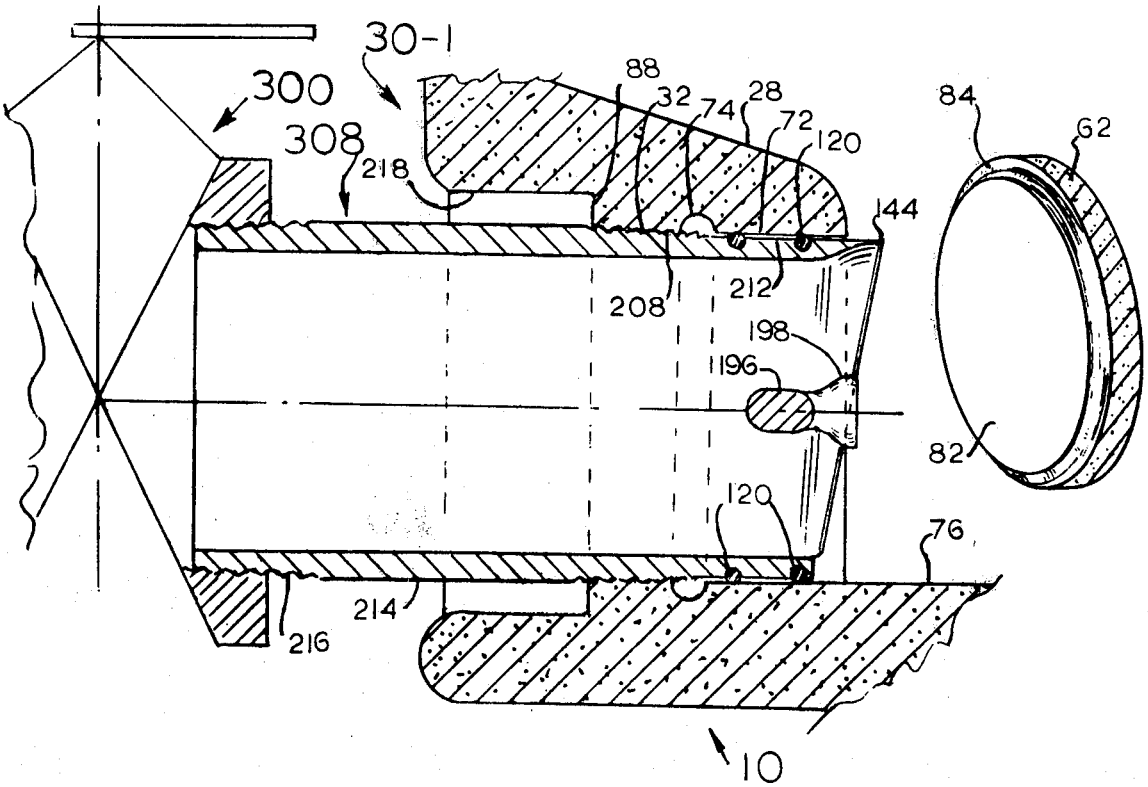

FIGS. 10 and 11 are illustrative views showing a cutting/tapping end adaptor 308 constructed in accordance with the present invention applied to a container with a connection similar to connection 30 when conditions do not require seizing and controlling the cutout blank. Connection 30–1 is shown identical to typical connecton 30 except threads 86 have been omitted and replaced by cylindrical section 218.

Adaptor 308 being similar to adaptor 304 in that cutter tip 144, O-ring seal elements 120, support 196 with prod 198 are identical to those of like numbers of adaptor 304 and perform like functions.

Adaptor 308 has pipe threads 216 to receive valve 300 or the like, cylindrical surface 214 leading to pipe threads 208 which lead to cylindrical surface 212 which has annular recesses to receive O-ring seal elements 120 and has cutter tip 144 affixed at the end. Internal cylindrical surface 188 of adaptor 308 has support 196 affixed that centrally positions prod 198, a part thereof, to contact blank 62 of connection 30–1 to thrust same free at the subsequent cutting/tapping operation.

While the cutting/tapping unit or adaptors illustrated show removing the connection's blank for full flow dispensing of the container's contents a partial cutting-/tapping can be effected with said unit or adaptor where the blank when partially cut is prodded to hinge inward providing a restricted flow at dispensing the container's contents.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A container tapping device for cutting/tapping the internal end wall section of a specifically designed plastic and the like container connection where said device is comprised of a pair of axially overlapping conduit members swivelly keyed to each other by a split annular ring and a retaining nut permitting the pair to rotate independently about a common axis with the outer member being the leading member which has outer right hand raised male attachment threads and cylindrical trunk section with seal elements for the sealable engagement within said container connection where said cylindrical trunk section being the leading end has a circle cutting tip foremost on a partial cylindrical shroud which aids in the alignment control of the cutting and removal of said wall section along with aid from a corkscrew type tip attached to the leading square end of an internal traveller shaft positioned on the axis of said conduit members where said square end is slidably received by a square holed housing retained in position by the outer conduit member while the trailing end of said shaft has left hand male threads engagingly received by a threaded boss positioned and supported by the trailing inner conduit member, whereupon at the engagement of said device within said container connection clockwise rotation of the outer conduit member sealably positions said seal elements, advances said corkscrew type tip to engage said container connection wall section, advances said cutting tip and shroud to cut said wall section circularly whereafter clockwise rotation of the inner conduit member advances said traveller shaft along with said engaged wall section into said container in a non rotating manner whereupon and as desired after dispensing said container's contents counter clockwise rotation of said inner conduit member will withdraw said traveller shaft and said engaged wall section in a non rotating manner which causes said engaged wall section to become substantially wedged within the cutting tip and shroud after which said device along with said engaged wall section is removed from said container connection by the counter clockwise rotation of the outer conduit member.

2. The combination of claim 1 wherein said engagement of said device within said container connection during clockwise rotation of the outer conduit member sealably positions said seal elements, advances said corkscrew type tip to engage said container connection wall section, advances said cutting tip and shroud to cut said wall section circularly whereafter clockwise rotation of the inner conduit member advances said traveller shaft along with said engaged wall section into said container in a nonrotating movement and in a manner not to restrict the container's liquid content flow through the cutting/tapping device at dispensing said liquid.

3. The combination of claim 1 wherein said engagement of said device within said container connection during clockwise rotation of the outer conduit member sealably positions said seal elements, advances said corkscrew type tip to engage said container connection wall section, advances said cutting tip and shroud to cut said wall section circularly whereafter clockwise rotation of the inner conduit member advances said traveller shaft along with said engaged wall section into said container in a nonrotating manner whereupon and as desired after dispensing said container's contents counter clockwise rotation of said inner conduit member will withdraw said traveller shaft and said engaged wall section in a nonrotating manner which causes said engaged wall section to become substantially wedged within the cutting tip and shroud end of the outer conduit member's cylindrical trunk providing control of said wall section in a manner that is substantially contained by said cylindrical trunk due to said wedging procedure wherein said wall section will be prevented from being disengaged from said corkscrew type tip conceivably by friction forces upon said wall section's edge against the container connection's cylindrical trunk sealing area at counter clockwise rotation of the outer conduit member at unit removal.

4. The combination of claim 1 wherein said outer member being the leading member has outer right hand raised male attachment threads and a cylindrical trunk section with seal elements for the sealable engagement within said container connection whereupon at the engagement of said device within said container connection clockwise rotation of the outer conduit member sealably positions said seal elements where the outer conduit member's cylindrical trunk section with seal elements has said seal elements positioned with respect to said outer conduit member's container connection engagement threads and said trunk section's cutting tip and shroud in a manner whereupon at the cutting/tapping of said connection the escapement of liquids, gases and pressures are prevented during all interims of the cutting/tapping procedure.

5. The combination of claim 1 wherein said corkscrew type tip attached to the leading square end of an internal traveller shaft positioned on the axis of said conduit members where the square end is slidably received by a square holed housing retained in position by the outer conduit member while the trailing end of said shaft has left hand male threads engagingly received by a threaded boss positioned and supported by the trailing inner conduit member providing the manner of support for the traveller shaft with corkscrew type tip attached so rotary movement only of said tip is controlled by the rotation of both said conduit members in the same direction and at same revolution per instant.

6. The combination of claim 1 wherein said corkscrew type tip attached to the leading square end of an internal traveller shaft positioned on the axis of said conduit members where said square end is slidably received by a square holed housing retained in position by the outer conduit member while the trailing end of said shaft has left hand male threads engagingly received by a threaded boss positioned and supported by the trailing inner conduit member providing the manner of support for the traveller shaft with corkscrew type tip attached so the combination rotary and lineal movement of the corkscrew type tip is controlled by the rotation of the outer conduit member only while the inner conduit member is held nonrotatable.

7. The combination of claim 1 wherein said corkscrew type tip is attached to the leading square end of an internal traveller shaft positioned on the axis of said conduit members where said square end is slidably received by a square holed housing retained in position by the outer conduit member while the trailing end of said shaft has left hand male threads engagingly received by a threaded boss positioned and supported by the trailing inner conduit member providing the manner of support for the traveller shaft with corkscrew type tip attached so the lineal movement only of said tip is controlled by the rotation of the inner conduit member only while the outer member is held nonrotatable.

8. The combination of claim 1 wherein after dispensing said container's contents said counter clockwise rotation of said inner conduit member will withdraw said traveller shaft and said engaged wall section in a nonrotating manner which causes said engaged wall section to become substantially wedged within the cutting tip and shroud where said shroud end of the outer member's cylindrical trunk includes the configuration to receive the engaged container end wall section as a valve seat with said end wall section being the valve proper to prevent the undesireable escapement of fumes at interims of piping attachment changes on the inner conduit member.

9. The combination of claim 1 wherein said corkscrew type tip attached to the leading square end of an internal traveller shaft positioned on the axis of said conduit members where said square end is slidably received by a square holed housing retained in position by the outer conduit member while the trailing end of said shaft has left hand male threads engagingly received by a threaded boss positioned and supported by the trailing inner conduit member this instant for a manner of operation that a desireable forward thrust force is provided where said corkscrew type tip advances faster than said cutting tip and shroud to aid in cutting the container connection's end wall section by said thrust force deforming said wall section centrally further forward with said faster advance to free the cutting tip and shroud as the cutting/tapping unit advances when the outer conduit member is rotated clockwise within the specific container connection with said faster advance and thrust force provided for said corkscrew type tip where said traveller shaft advances with the outer conduit member in its advance on its right hand container connection engagement threads while said traveller shaft can also have an added advance upon its own left hand threads being engaged within said housing of the inner conduit member by rotating the inner conduit member clockwise faster than the outer conduit member is being rotated clockwise.

* * * * *